US008562090B2

(12) United States Patent
Igarashi

(10) Patent No.: US 8,562,090 B2
(45) Date of Patent: Oct. 22, 2013

(54) IMAGE FORMING APPARATUS AND METHOD FOR CONTROLLING THE SAME

(75) Inventor: Masanori Igarashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 298 days.

(21) Appl. No.: 13/041,852

(22) Filed: Mar. 7, 2011

(65) Prior Publication Data

US 2011/0221801 A1 Sep. 15, 2011

(30) Foreign Application Priority Data

Mar. 15, 2010 (JP) ..... 2010-057422

(51) Int. Cl.
*B41J 29/38* (2006.01)

(52) U.S. Cl.
USPC ..... 347/6

(58) Field of Classification Search
USPC ..... 347/6
See application file for complete search history.

(56) References Cited

U.S. PATENT DOCUMENTS 5,010,354 A 4/1991 Cowger et al.
7,240,999 B2 * 7/2007 Kumagai et al. ..... 347/85
7,427,127 B2 9/2008 Ando et al.
2008/0136849 A1 6/2008 Kaneko
2008/0273046 A1 * 11/2008 Ishinaga et al. ..... 347/6
2008/0297545 A1 * 12/2008 Umeda ..... 347/5

FOREIGN PATENT DOCUMENTS

| | | |
|---|---|---|
| JP | 2898746 | 3/1999 |
| JP | 2003-341028 | 12/2003 |
| JP | 2005-125667 | 5/2005 |
| JP | 2008-143073 | 6/2008 |
| JP | 2009-23329 | 2/2009 |
| JP | 2009-274325 | 11/2009 |

* cited by examiner

*Primary Examiner* — Manish S Shah
*Assistant Examiner* — Jeffrey C Morgan
(74) *Attorney, Agent, or Firm* — Cooper & Dunham LLP

(57) ABSTRACT

A method for controlling an image forming apparatus including a head having a nozzle for discharging a liquid droplet; a sub-tank for temporarily storing the liquid supplied to the head; a main tank for storing the liquid; a pump capable of forwardly sending the liquid from the main tank to the sub-tank and reversely sending the liquid from the sub-tank to the main tank; and a sensor for sensing a pressure in the sub-tank is provided. In the method, before sending the liquid forwardly or reversely to achieve a target negative pressure in the sub-tank, a pressure sensing function of the sensor is checked by sending the liquid with the pressure in the sub-tank being at a negative pressure range in which a meniscus of the liquid is maintained. When the pressure sensing function is determined abnormal, a control is performed not to send the liquid by the pump.

7 Claims, 12 Drawing Sheets

IMAGE FORMING APPARATUS AND METHOD FOR CONTROLLING THE SAME

BACKGROUND OF THE INVENTION

1. Field of the Invention

The present invention relates to an inkjet recording type image forming apparatus and a method for controlling the inkjet recording type image forming apparatus.

2. Description of the Related Art

As an image forming apparatus such as a printer, a facsimile, and a copier, an inkjet recording type image forming apparatus using a recording head that discharges ink droplets has been known. Such a liquid discharge recording type image forming apparatus performs image formation by discharging ink droplets from the recording head onto a conveyed recording medium (hereinafter referred to simply as "sheet" in some cases). In such liquid discharge recording type image forming apparatuses, there are a serial type image forming apparatus that forms an image by discharging liquid droplets while a recording head is moving in a main scanning direction, and a line type image forming apparatus using a line type head, which forms an image by discharging liquid droplets in a state where a recording head is not moving.

In such an image forming apparatus (hereinafter also referred to simply as "inkjet recording apparatus"), for example, there has been known an apparatus in which a head tank (sub-tank) for supplying ink to a recording head is mounted on a carriage on which the recording head is mounted, an ink cartridge (main tank) is detachably mounted on an apparatus body side, and ink is supplied from the ink cartridge on the apparatus body side to the head tank.

A pressure in the head tank used in such an apparatus is required to be held at a normal pressure for preventing ink leakage and inclusion (suction) of air from inside a nozzle. Therefore, the following controlling technique has been known. While the pressure in the head tank is held at a normal pressure by using a pressure sensing function of a unit for sensing a pressure in the head tank, ink is supplied and a negative pressure is formed.

However, by the conventional methods of ink supplying and ink discharging at the time of negative pressure formation, there have been the following problems. When the pressure sensing function in the head tank does not function due to a breakdown of a pressure sensing lever and the like, a machine operation is not stopped even when a pressure in the target head tank is at a target pressure value, and the ink continues to be supplied and discharged. If the ink is supplied even after the target negative pressure value is achieved, ink is excessively supplied and leaks out from the head tank. Further, when the ink continues to be discharged even after the target negative pressure value is achieved, there has been a problem in that the pressure in the head tank becomes an excessive negative pressure, whereby air is suctioned from inside the nozzle and a defect of discharge of the ink occurs.

Factors that prevent the pressure sensing function from functioning are: 1. defect of an atmospheric opening mechanism of the head tank; 2. adhesion of a filler; 3. abnormality of a full state sensor; and the like.

The "1. defect of an atmospheric opening mechanism of the head tank" is a defect where the atmospheric opening mechanism does not function even when an atmospheric opening valve is pressed. For example, there are (1-1) an atmospheric opening mechanism defect caused by liquid intruding into an atmospheric opening part, (1-2) an atmospheric opening mechanism defect caused by pressing the atmospheric opening valve in a state where a carriage is misaligned, and the like.

As for the defect (1-1) described above, there are cases where the atmospheric opening mechanism does not easily function due to an intrusion of liquid in the atmospheric opening part. In such a situation, there is a case where it takes time to perform atmospheric opening even by pressing the atmospheric opening valve, whereby a filler keeps a slightly closed state.

As for the defect (1-2) described above, there is a case where the carriage is misaligned due to skipping of reading of a main scanning part encoder. Even by pressing the atmospheric opening valve in the case of the misaligned carriage, the atmospheric opening does not function, and the filler is in a slightly closed state.

The "2. adhesion of a filler" is a defect where the filler is adhered to something and does not move, so the pressure sensing function does not function. For example, there are (2-1) an adhesion to a partition between heads, (2-2) an adhesion to the head tank, and the like.

The defect (2-1) is as follows. Plural heads in the carriage are separated by partitions per head. When the filler is opened at the time of atmospheric opening and the like, the filler sometimes contacts the partition between the heads. A contact part of the filler may adhere by "adhesion by electrostatic force" and "adhesion by surface tension or an adhesion force due to an attached liquid, solid, or the like".

The defect (2-2) is as follows. When ink is consumed, the filler is closed and may contact the head tank. A contact part of the filler may adhere by "adhesion by electrostatic force" and "adhesion by a surface tension or an adhesion force due to an attached liquid, solid, or the like". Even when ink is supplied in this state, the filler does not move. In addition, the filler is not moved even by pressing the atmospheric opening.

The "3. abnormality of a full state sensor" is a defect where there is an abnormality in the full state sensor, so that the filler cannot be accurately sensed and the pressure sensing function does not function. There are some cases where the sensor senses other matter than the filler by mistake, such as "paper dust", "mist", and "ink droplet". As a result, the filler does not function.

For example, Japanese Patent Application Publication No. 2008-143073 (Patent Document 1) discloses the following mechanism against the ink leakage and inclusion (suction) of air from inside the nozzle. In this mechanism, a pressure sensing function using a pressure sensing lever is used to supply ink to achieve a target negative pressure value, for preventing an ink leakage caused by an excessive ink supply.

Japanese Patent Application Publication No. 2005-125667 (Patent Document 2) suggests a liquid discharge apparatus including ink supply piping for supplying ink from an ink tank to an ink head, and ink circulation piping for returning the ink from the ink head to the ink tank. The ink is circulated between the ink head and ink tank for preventing the ink leakage from a nozzle.

Japanese Patent Application Publication No. 2003-341028 (Patent Document 3) suggests an inkjet printer having an intermediate ink tank between an ink cartridge and a recording head, and a pressure sensor mounted in a place apart from the intermediate ink tank. A negative pressure state inside the recording head is sensed by the pressure sensor and the intermediate ink tank is moved up and down as required to maintain a desired negative pressure.

Japanese Patent No. 2898746 (Patent Document 4) suggests an inkjet pen in which ink is supplied in a sealed ink tank, a small hole having one end opened to the atmosphere is provided in this ink tank, and air is supplied through the small hole into the ink tank when the ink in the ink tank is consumed, whereby pressure in the ink tank is kept at a desired negative pressure.

Patent Document 1: Japanese Patent Application Publication No. 2008-143073

Patent Document 2: Japanese Patent Application Publication No. 2005-125667

Patent Document 3: Japanese Patent Application Publication No. 2003-341028

Patent Document 4: Japanese Patent No. 2898746

In the techniques described in these documents, however, the problem of "ink leakage" and problem that "pressure in the head tank becomes an excessively negative pressure" cannot be solved in a state where the pressure sensing function of the pressure sensing lever for sensing a pressure in the head tank does not function due to a breakdown and the like.

SUMMARY OF THE INVENTION

It is an object of at least one embodiment of the present invention to solve the above-described problems of a conventional inkjet recording type image forming apparatus, and provide an image forming apparatus capable of preventing an ink leakage and inclusion of air from a nozzle, and forming a high quality image.

According to one aspect of the invention, there is provided a method for controlling an image forming apparatus including a liquid droplet discharge head having a nozzle configured to discharge a droplet of liquid; a sub-tank configured to temporarily store the liquid supplied to the liquid droplet discharge head; a main tank configured to store the liquid; a liquid sending pump capable of sending the liquid from the main tank to the sub-tank by forward sending and sending the liquid from the sub-tank to the main tank by reverse sending; and a pressure sensing unit configured to sense a pressure in the sub-tank. In the method, before sending the liquid by the forward sending or the reverse sending by the liquid sending pump to achieve a target negative pressure value of a pressure in the sub-tank, a determination is made of whether a pressure sensing function of the pressure sensing unit is normal by sending the liquid by the liquid sending pump with the pressure in the sub-tank being at a negative pressure in a range in which a meniscus of the liquid formed in the nozzle is maintained; and when it is determined that the pressure sensing function is abnormal, a control is performed not to send the liquid by the liquid sending pump to achieve the target negative pressure value of the pressure in the sub-tank.

DETAILED DESCRIPTION OF THE PREFERRED EMBODIMENTS

Embodiments of the present invention are described below with reference to the drawings.

Figure 1:
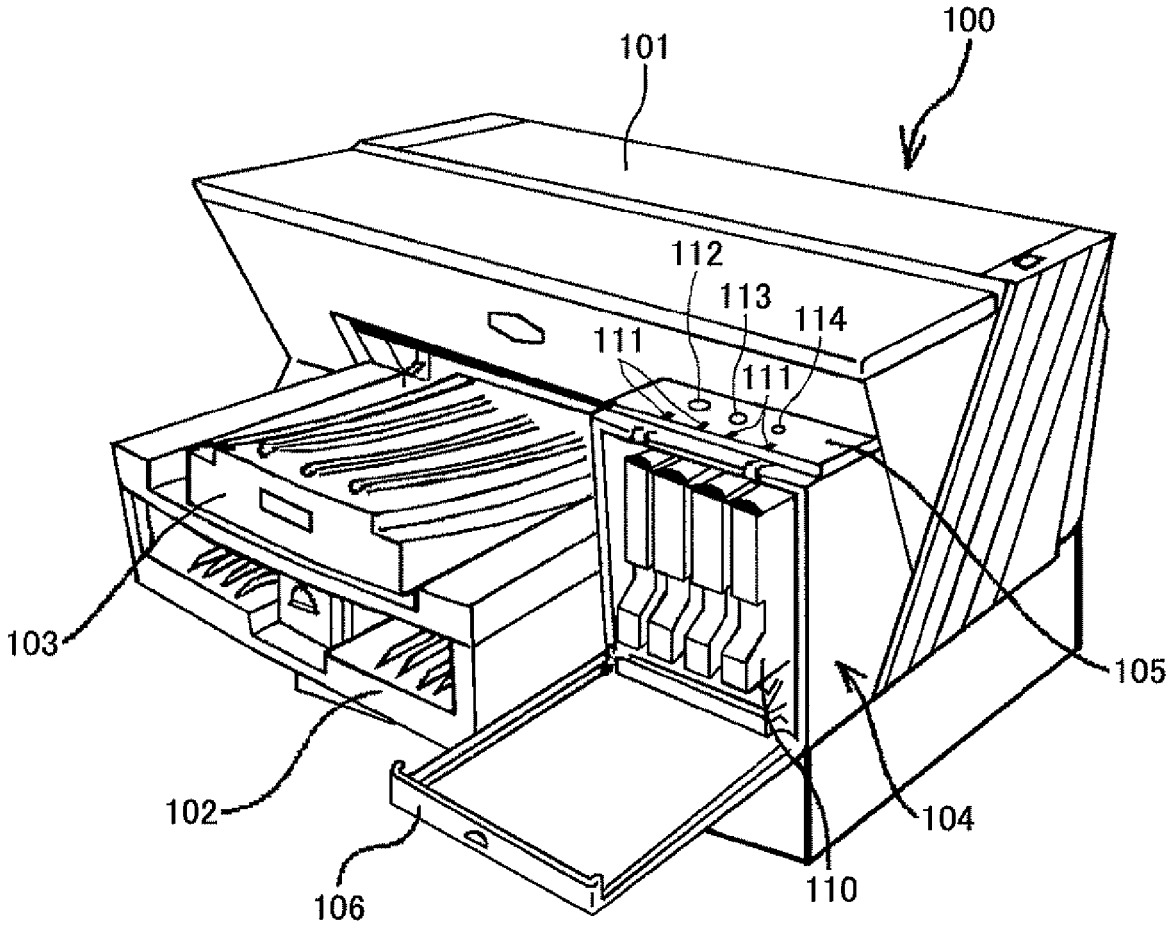
FIG. 1 is a perspective view of an inkjet recording apparatus that is an example of an image forming apparatus according to embodiments of the present invention, seen from a diagonally forward direction.

FIG. 1 is a perspective view of an inkjet recording apparatus that is an example of an image forming apparatus according to embodiments of the present invention, seen from a diagonally forward direction. An inkjet recording apparatus 100 of this embodiment, which is shown in FIG. 1, includes an apparatus body 101, a sheet feed tray 102 mounted on the apparatus body 101 for loading sheets, and a sheet discharge tray 103 that is detachably mounted on the apparatus body 101 and stocks sheets on which images are formed. On one side of a front surface of the apparatus body 101, a cartridge loading part 104 for loading ink cartridges is provided adjacent to the sheet feed and discharge tray parts. On an upper surface of the cartridge loading part 104, an operations/display part 105 is provided in which operation buttons, a display unit, and the like are arranged.

Four ink cartridges 110 are set in the cartridge loading part 104. The ink cartridges 110 house recording liquid (ink) that is color material of corresponding different colors, for example, ink colors of black (K), cyan (C), magenta (M), and yellow (Y). These ink cartridges 110 can be inserted from the front surface side to a rear side of the apparatus body 101 to be loaded. The ink cartridges 110 are configured to be loaded so as to be laterally aligned in upright states. On the front surface side of the cartridge loading part 104, a cover (cartridge cover) 106 that opens when attaching and detaching the ink cartridges 110 is openably and closably provided.

In the operations/display part 105, four remaining amount display parts 111 are arranged at positions corresponding to the mounting positions (arrangement positions) of the ink cartridges 110 of the respective colors. The remaining amount display parts 111 display that the remaining amounts of the ink cartridges 110 of respective colors are nearly empty or empty. In this operations/display part 105, a power source button 112, a sheet send/print restart button 113, and a cancel button 114 are arranged.

Figure 2:
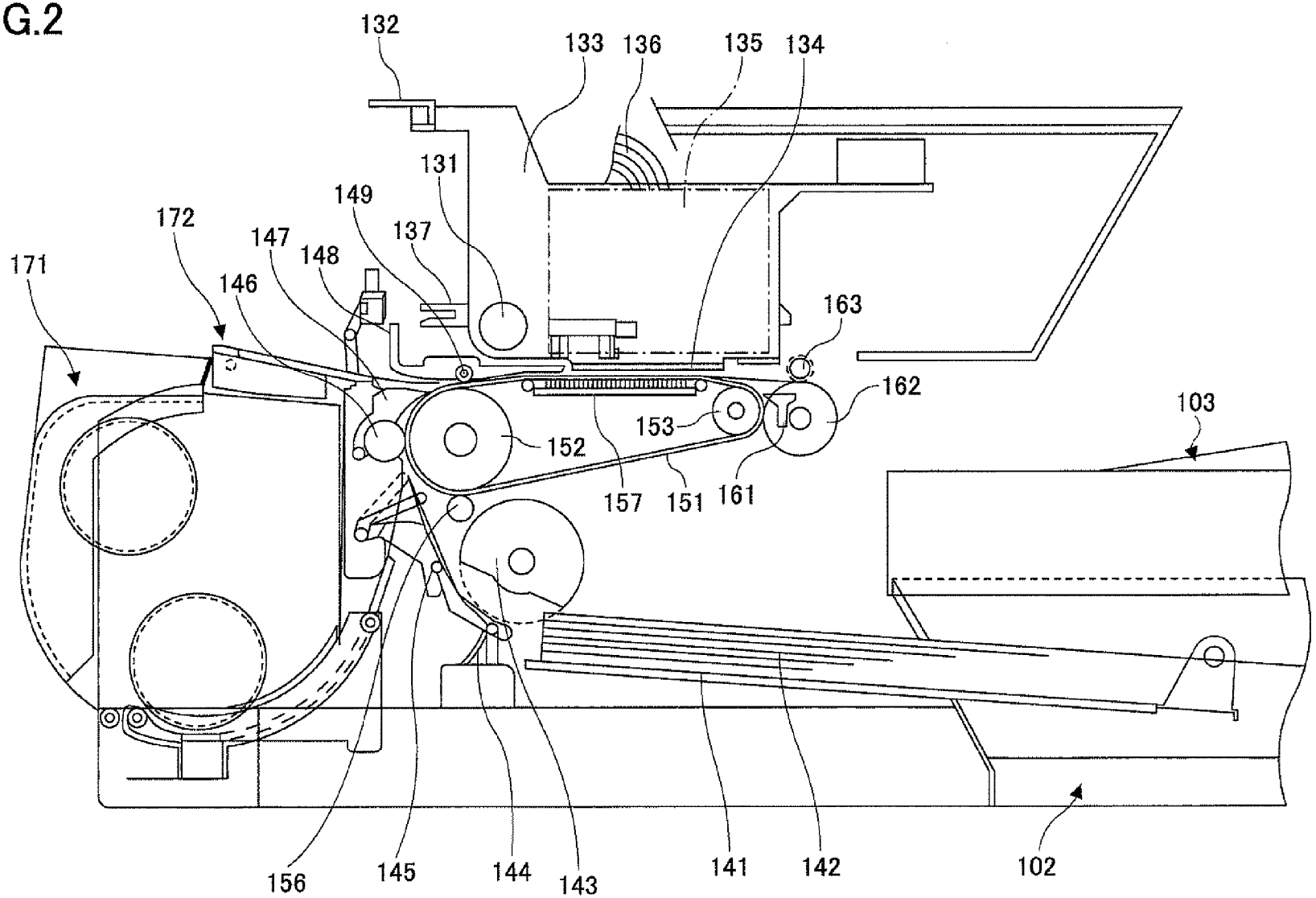
FIG. 2 is a schematic side view of a mechanical part of the inkjet recording apparatus shown in FIG. 1.
Figure 3:
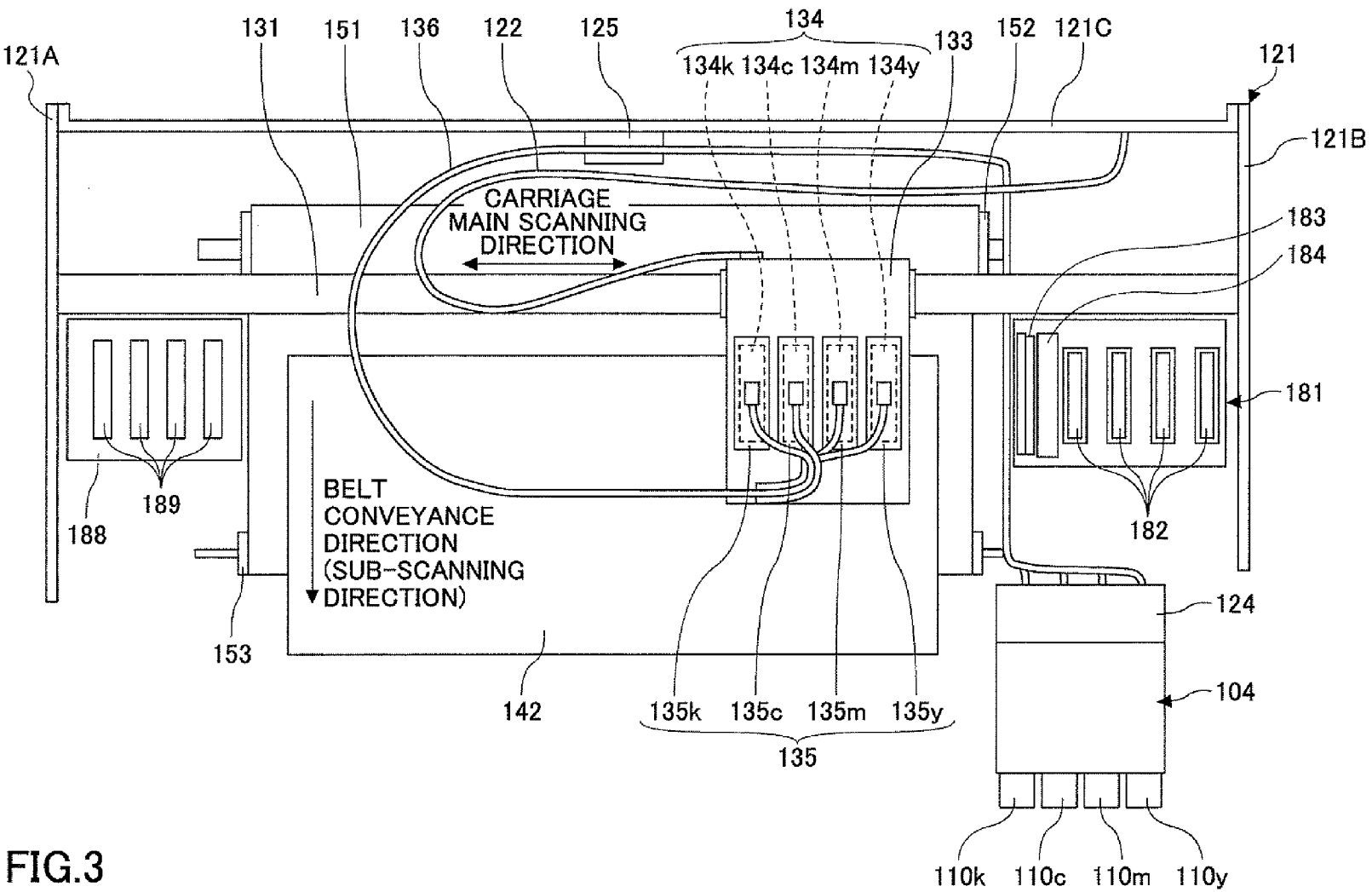
FIG. 3 is a plan view of a main part of the inkjet recording apparatus shown in FIG. 1.

Next, a mechanical part of this inkjet recording apparatus is described with reference to FIGS. 2 and 3. Note that FIG. 2 is a schematic side view showing the mechanical part, and FIG. 3 is a plan view of a main part of the ink jet recording apparatus.

In the mechanical part of the inkjet recording apparatus, a carriage 133 is held slidably in a main scanning direction by a stay 132 and a guide rod 131 that is a guide member laterally laid between left and right side plates 121A and 121B that form a frame 121. By a main scanning motor that is not shown, the carriage 133 is moved and scans in a direction indicated by an arrow in FIG. 3 (carriage main scanning direction) via a timing belt. The inkjet recording apparatus of this embodiment is a serial type image forming apparatus that forms an image by discharging ink from a recording head moving in the main scanning direction.

Recording heads 134, which are formed of four liquid droplet discharge heads for discharging droplets of the ink of respective colors of yellow (Y), cyan (C), magenta (M), and black (Bk) as described above, are mounted on the carriage 133. The recording heads 134 are mounted on the carriage 133 with plural ink discharge outlets of the recording heads 134 aligned in a direction crossing the main scanning direction, and an ink droplet discharge direction being downward.

As an inkjet head to constitute the recording head 134, an inkjet head including a piezoelectric actuator such as a piezoelectric element, a thermal actuator utilizing a phase change caused by a film boiling of liquid by using an electrothermal element such as a heat generating resistor, a shape-memory alloy actuator using a metal phase change caused by a temperature change, an electrostatic actuator using an electrostatic force, and the like as a pressure generating unit that generates pressure for discharging liquid droplets, and the like can be used.

A driver IC is mounted on the recording heads 134 and connected to a control part (not shown) via a harness (flexible printed cable) 122. The carriage 133 has mounted head tanks 135 of respective colors for supplying the inks of the respective colors to the recording heads 134. The inks of the respective colors are supplied from the ink cartridges 110 of the respective colors, which are mounted on the cartridge loading part 104 as described above, to the head tanks 135 of the respective colors via ink supply tubes 136 of the respective colors. This cartridge loading part 104 is provided with a supply pump unit 124 for sending the inks in the cartridges 110. The ink supply tubes 136 are held by a stopper 125 to a rear plate 121C that forms a portion of the frame 121 in midstream of running of the tubes 136.

Meanwhile, as a sheet feed part for feeding sheets 142 stacked on a sheet stack part (platen) 141 of the sheet feed tray 102, a half-moon roller (sheet feed roller) 143 for separating and feeding the sheets 142 one by one from the sheet stack part 141 and a separation pad 144 that faces the sheet feed roller 143 and is formed of a material with a high friction coefficient are provided. The separation pad 144 is biased toward the sheet feed roller 143 side.

In order to send the sheet 142 fed from the sheet feed part to a lower side of the recording head 134, a guide member 145 for guiding the sheet 142, a counter roller 146, a conveyance guide member 147, and a pressing member 148 having a leading end pressing roller 149 are provided. In addition, a conveyance belt 151 serving as a conveyance unit for electrostatically attracting the fed sheet 142 and conveying the sheet 142 at a position facing the recording head 134 is provided.

The conveyance belt 151 is an endless belt stretched between a conveyance roller 152 and a tension roller 153 and configured to rotate in a belt conveyance direction (sub-scanning direction).

In addition, a charging roller 156 serving as a charging unit for charging a surface of the conveyance belt 151 is provided. The charging roller 156 contacts a surface layer of the conveyance belt 151 and is arranged to rotate following a rotation of the conveyance belt 151. On a back side of the conveyance belt 151, a guide member 157 is arranged so as to correspond to a print area of the recording heads 134.

The conveyance roller 152 is rotated by a sub-scanning motor (not shown) via a timing belt, so that the conveyance belt 151 is rotated in the belt conveyance direction shown in FIG. 3.

As a sheet discharge part for discharging the sheet 142 recorded on by the recording head 134, a separation claw 161 for separating the sheet 142 from the conveyance belt 151, and a sheet discharge roller 162 and a sheet discharge roller 163 are provided. The sheet discharge tray 103 is provided below the sheet discharge roller 162.

A double-side unit 171 is detachably mounted on a back surface part of the apparatus body 101. When the conveyance belt 151 rotates in the reverse direction to return the sheet 142, the double-side unit 171 receives the sheet 142 and turns the sheet 142 upside down to feed the sheet 142 again between the counter roller 146 and conveyance belt 151. An upper surface of the double-side unit 171 is used as a manual feed tray 172.

As shown in FIG. 3, a maintenance recovery mechanism 181 including a recovery unit is arranged in a non-printing area that is on one side in the main scanning direction of the carriage 133. The maintenance recovery mechanism 181 maintains and recovers nozzle conditions of the recording heads 134.

The maintenance recovery mechanism 181 includes cap members (hereinafter referred to as "caps") 182 for capping nozzle faces of the recording heads 134, a wiper blade 183 serving as a blade member for wiping the nozzle faces, a maintenance discharge receiver 184 for receiving liquid droplets generated during a maintenance ejection to discharge ink droplets that do not contribute to recording for discharging a thickened recording ink, and the like. Here, one cap 182 on a left end may be used as a cap for ink suction and moisture retention, and other caps 182 may be used as caps for moisture retention.

Waste liquid of the recording liquid generated by the maintenance recovery operation by the maintenance recovery mechanism 181, ink discharged to the caps 182, ink attached to the wiper blade 183 and removed by the wiper cleaner 185, and ink discharged to the maintenance discharge receiver 184 by the maintenance discharge are discharged and stored in a waste liquid tank (not shown).

As shown in FIG. 3, in a non-printing area on a side opposite to the maintenance recovery mechanism 181, a maintenance discharge receiver 188 is arranged for receiving liquid droplets generated during a maintenance discharge for discharging liquid droplets that do not contribute to recording in order to discharge a thickened recording liquid during recording and the like. The maintenance discharge receiver 188 is provided with openings 189 arranged in parallel with the rows of nozzles of the recording heads 134, and the like.

In the inkjet recording apparatus of this embodiment having the above-described configuration, the sheets 142 are separated and fed one by one from the sheet feed tray 102, fed substantially vertically upward, guided by the guide 145, and conveyed between the conveyance belt 151 and counter roller 146. Further, a leading end of the sheet 142 is guided by the conveyance guide member 147 and pressed to the conveyance belt 151 by the leading end pressing roller 149 to turn the conveyance direction of the sheet 142 by substantially 90°.

At this time, an AC (alternating current) bias supply part of a control part described below repeats outputs of a positive voltage and a negative voltage alternately to the charging roller 156, namely, applies an alternating voltage to the charging roller 156. As a result, the conveyance belt 151 is charged by an alternating charging voltage pattern, that is, the conveyance belt 151 is charged with an alternating band pattern of positively-charged areas and negatively-charged areas at predetermined widths in the sub-scanning direction which is the rotation direction. When the sheet 142 is fed onto the conveyance belt 151 which is charged alternately with the positive and negative charges, the sheet 142 is attracted on the conveyance belt 151 and conveyed in the sub-scanning direction by the rotation of the conveyance belt 151.

By driving the recording head 134 in response to image signals while moving the carriage 133 in the main scanning direction based on main scanning position information detected by a linear encoder 137 (FIG. 2), ink droplets are discharged on the sheet 142, which is stopped, to record one line, and the sheet 142 is conveyed by a predetermined distance to record the next line. Upon receiving a signal that the image has been recorded or a rear end of the sheet 142 has arrived at the recording area, the recording operation is finished and the sheet 142 is discharged to the sheet discharge tray 103.

In waiting for the next printing (recording) operation, the carriage 133 is moved to the maintenance recovery mechanism 181 side and the recording heads 134 are capped by the caps 182 so that moisture of the nozzles is kept to prevent a discharge failure caused by ink drying. In a state where the recording heads 134 are capped by the caps 182, the recording liquid is suctioned from the nozzles by a suction pump (not shown) (referred to as "nozzle suctioning" or "head suctioning"), to perform a recovery operation to discharge a thickened recording liquid and air bubbles. A maintenance discharge operation to discharge ink that is not used for recording an image on the sheet is performed before the recording operation, during the recording operation, and the like. Such maintenance operations allow maintaining a stable discharge performance of the recording heads 134.

Figure 4:
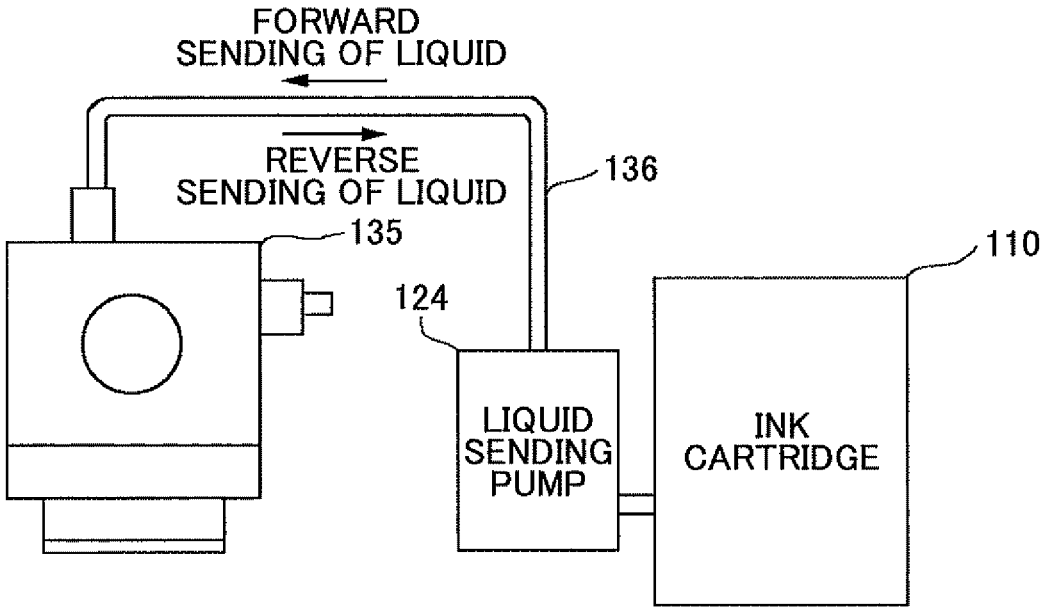
FIG. 4 is a schematic configuration diagram showing a configuration of ink supply piping.

FIG. 4 is a schematic configuration diagram showing a configuration of ink supply piping of the inkjet recording apparatus of this embodiment. As shown in FIG. 4, the inkjet recording apparatus of this embodiment returns (flows back) the ink in the head tank 135 to the ink cartridge 110 by the liquid sending pump (supply pump) 124 instead of discharging the ink from the nozzle faces and collecting the ink in the waste liquid tank. Such a configuration allows reusing of the ink used for forming a negative pressure.

Figure 5:
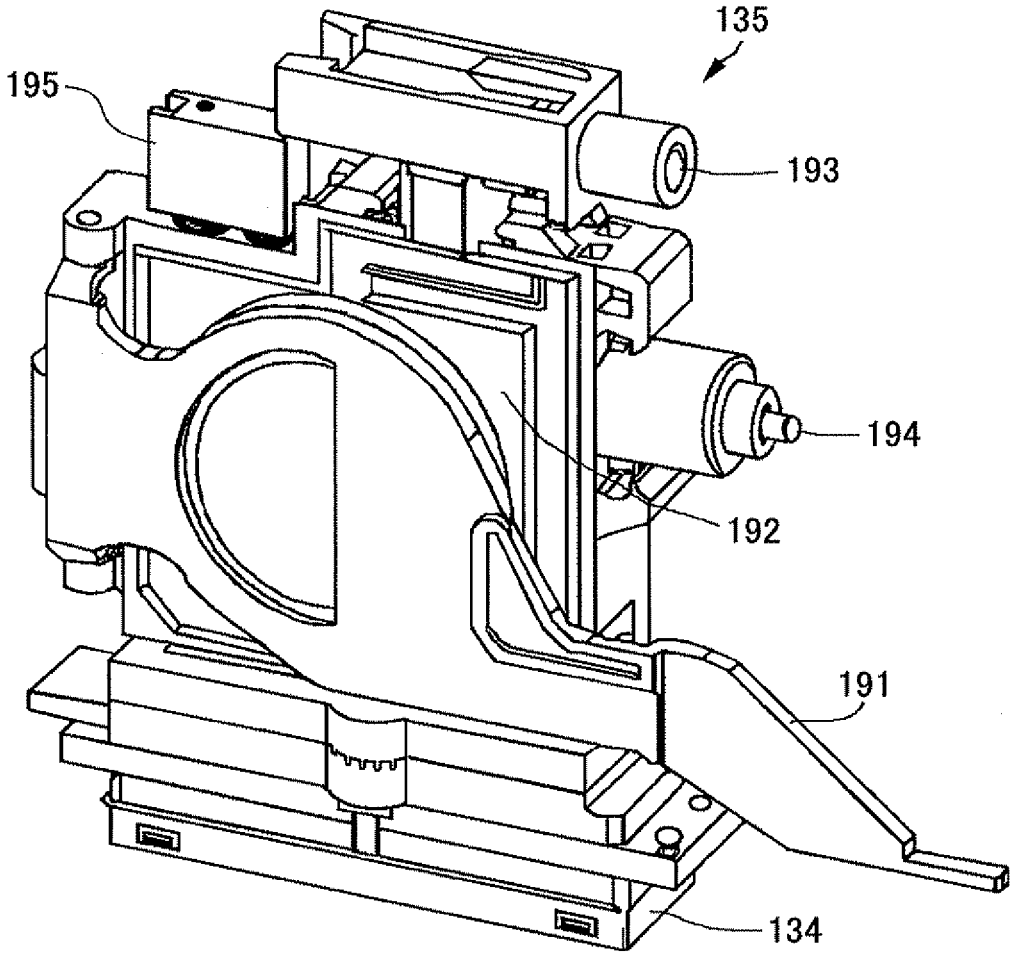
FIG. 5 is a perspective view showing a structure of a head tank.

FIG. 5 is a perspective view showing a structure of a head tank 135 of the inkjet recording apparatus of this embodiment. In FIG. 5, a negative pressure lever 191 is provided on the head tank 135 and operated by a film 192 that is displaced in accordance with a consumed amount of ink stored in the head tank 135. The head tank 135 is negatively pressurized by a spring, not shown, which is provided in the head tank 135 to bias the film 192. Ink is supplied from the ink cartridge 110 via the ink supply tube 136 through a supply inlet 193. An air-release pin 194 is a pin with which the interior of the head tank 135 is opened to the atmosphere when needed. In addition, a sensor mechanism 195 for sensing the ink or air is provided. Further, the recording heads 134 for ejecting ink droplets are attached below the head tanks 135.

Figure 6:
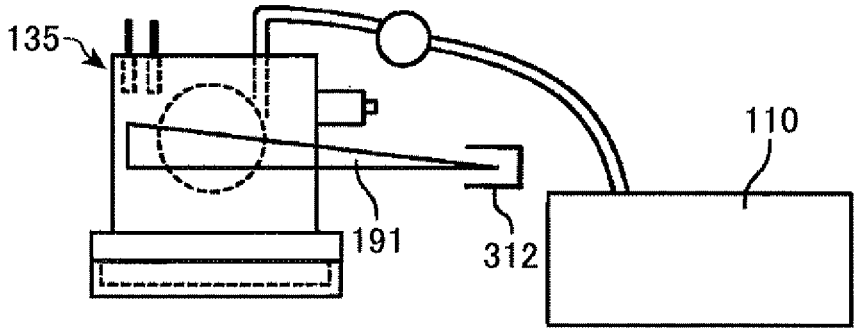
FIG. 6 is a schematic diagram showing a positional relationship of a negative pressure lever of the head tank and a sensor for sensing a position of the negative pressure lever.

FIG. 6 is a schematic diagram showing a positional relationship between the negative pressure lever 191 of the head tank 135 and a sensor 312 for sensing a position of the negative pressure lever 191. By using the head tank 135 structure and the negative pressure lever 191 as shown in FIG. 5, a function for sensing an amount of discharged liquid in the head tank and a function for sensing a pressure in the head tank can be provided by determining a displacement amount of the negative pressure lever 191 that moves in accordance with the consumed amount of ink in the head tank 135 (amount of discharged liquid in the head tank 135).

Since a relationship between the amount of discharged liquid in the head tank 135 and the displacement amount of the negative pressure lever 191 is determined to some extent, an amount of liquid to be sent can be adjusted. Specifically, there has been a method to read the negative pressure lever 191 before sending the liquid, move the carriage 133 by a displacement amount of a filler corresponding to a desired amount of liquid to be sent, send the liquid to displace the negative pressure lever 191, and stop sending the liquid at a moment when the sensor 312 senses the negative pressure lever 191.

Figure 7:
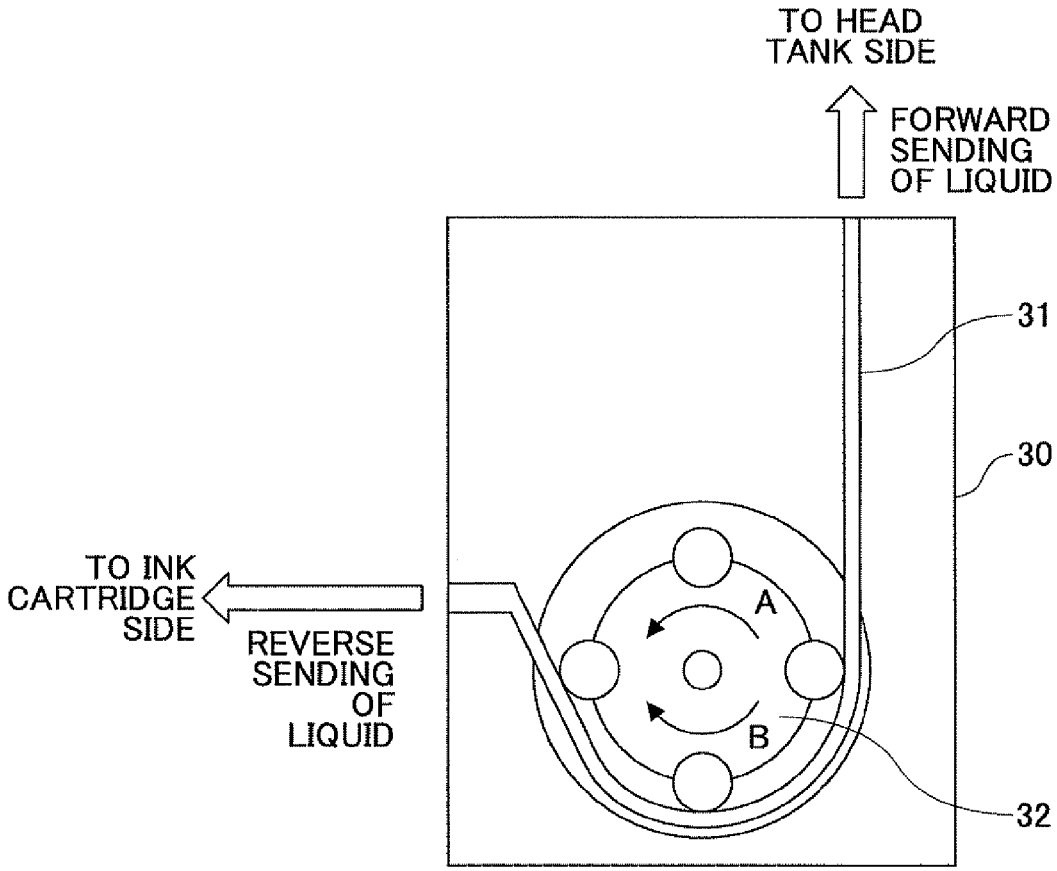
FIG. 7 is a schematic diagram describing a configuration of a liquid sending pump.

FIG. 7 is a schematic diagram describing a configuration of the liquid sending pump (supply pump 124). As the liquid sending pump 124 used in this embodiment, a tube pump as shown in FIG. 7 is used, which has a simple structure and is capable of forward and reverse sending of ink by changing a rotation direction of a driving motor. A rubber tube 31 for sending liquid runs inside this tube pump 30. The rubber tube 31 is partially pressed by a pump rotor 32 incorporated in the tube pump 30. By rotating the pump rotor 32, the pressed point of the rubber tube 31 moves in the rotation direction of the pump rotor 32 to send ink in the rotation direction of the pump rotor 32. Specifically, when ink is sent from the ink cartridge 110 to the head tank 135 by forward sending, the pump rotor 32 is rotated in a direction indicated by an arrow A. On the other hand, when ink is sent from the head tank 135 to the ink cartridge 110 by reverse sending, the pump rotor 32 is rotated in a direction indicated by an arrow B. In this regard, the rotation of the pump rotor 32 in the direction indicated by the arrow A is called a forward rotation, while the rotation of the pump rotor 32 in the direction indicated by the arrow B is called a reverse rotation. Accordingly, controlling the forward and reverse rotation of the pump rotor 32 allows controlling the sending directions of ink. Further, using the tube pump 30 with the simple structure as the liquid sending pump allows space saving of the liquid sending pump. In addition, controlling the sending direction of liquid by the forward and reverse control of the pump driving motor allows a simple configuration of the piping. Note that the structure of the tube pump 30 may be an eccentric cam type instead of a rotation roller type as shown in FIG. 7.

In the image forming apparatus of this embodiment, controls to supply the ink and form a negative pressure are performed while the pressure in the head tank is held at a normal pressure by using the pressure sensing function of the pressure sensing unit provided in the head tank. Subsequently, a control of negative pressure formation by the reverse sending of liquid, which is a feature of the present invention, is described with reference to the flowchart shown in FIG. 8.

Here, conditions are defined as follows, and various Md design values are known in advance.

v: Liquid sending speed of the supply pump (variable)

v_min: 0.15 cc/s: Minimum value of the liquid sending speed of the supply pump v_max: 0.60 cc/s: Maximum value of the liquid sending speed of the supply pump A: Amount of discharged liquid in the head tank (variable)

0 to 2.2 cc: Amount of discharged liquid in the head tank to keep a negative pressure value at which a meniscus can be held t: Seconds during which the reverse sending of liquid is performed by the supply pump (variable)

As an example, a description is made of a control to perform the reverse sending of liquid until a target negative pressure value (target value 0.6 cc of the amount of discharged liquid in the head tank) is achieved.

First, the amount A of discharged liquid in the head tank is adjusted to 0 cc (S1).

The amount A of discharged liquid in the head tank is adjusted to 0 cc by, for example, a method of pressing an atmospheric opening valve, supplying ink until an electrode pin senses a liquid surface, and then closing the atmospheric opening valve, as introduced in the conventional technique. The amount of discharged liquid in the head tank is defined as follows. A state of the head tank, which discharged an amount p[cc] of liquid from a state where a pressure in the head tank is the same as the external atmospheric pressure, is expressed such that the amount of discharged liquid in the head tank is p[cc]. That is, when the head tank whose internal pressure is the same as the external atmospheric pressure discharges the amount p[cc] of liquid, "the amount of discharged liquid in the head tank" of that head tank is p[cc]. In other words, the amount of discharged liquid in the head tank means an amount of liquid discharged from the head tank from a state where the internal pressure in the head tank is the same as the external atmospheric pressure. Therefore, for example, "an amount of discharged liquid in the head tank is 0.1 cc" means that the head tank is in a state where the 0.1 cc of liquid has been discharged from a state where its internal pressure is the same as the external atmospheric pressure. At this time, this head tank whose amount of discharged liquid is 0.1 cc has a negative internal pressure. Meanwhile, "an amount of discharged liquid in the head tank is −0.1 cc" means that the head tank is in a state where the 0.1 cc of liquid has been supplied in the state where its internal pressure is the same as the external atmospheric pressure. At this time, this head tank whose amount of discharged liquid is −0.1 cc has an internal pressure higher than the external atmospheric pressure.

Next, it is determined whether the pressure sensing function is normal in S2 to S7. This part corresponds to "mechanism for determining whether pressure sensing function is normal".

That is, in the case where the liquid is sent by the reverse sending of the supply pump and the amount of the sent liquid reaches 0.15 cc cc is an amount of liquid that can be sent in one second at the liquid sending speed of v_min) within specified seconds (one second), that is, when the amount of discharged liquid in the head tank reaches 0.15 cc within the specified seconds (one second), it is determined that the pressure sensing function is normal (S4). After it is determined that the pressure sensing function is normal, liquid is sent by the reverse sending until the target negative pressure value (0.6 cc) is achieved (S8 to S13).

On the other hand, in the case where the liquid is sent by the reverse sending of the supply pump and the amount of the sent liquid does not reach 0.15 cc (0.15 cc is an amount of liquid that can be sent by the reverse sending in one second at the liquid sending speed of v_min) within specified seconds (one second), that is, when the amount of discharged liquid in the head tank does not reach 0.15 cc within the specified seconds (one second), it is determined that the pressure sensing function is abnormal (S7). After it is determined that the pressure sensing function is abnormal, the process proceeds to S13, and a control method, by which the liquid is not sent by the reverse sending until the target negative pressure value (0.6 cc) is achieved, is used.

By controlling as described above, it can be determined whether the pressure sensing function is normal within a range of negative pressure values at which a meniscus can be held, even when the pressure sensing function is abnormal. When it is determined that the pressure sensing function is abnormal, the image forming apparatus is stopped in a state where the meniscus can be held, whereby inclusion of air from inside the nozzle due to an excessive negative pressure can be prevented.

Figure 8:
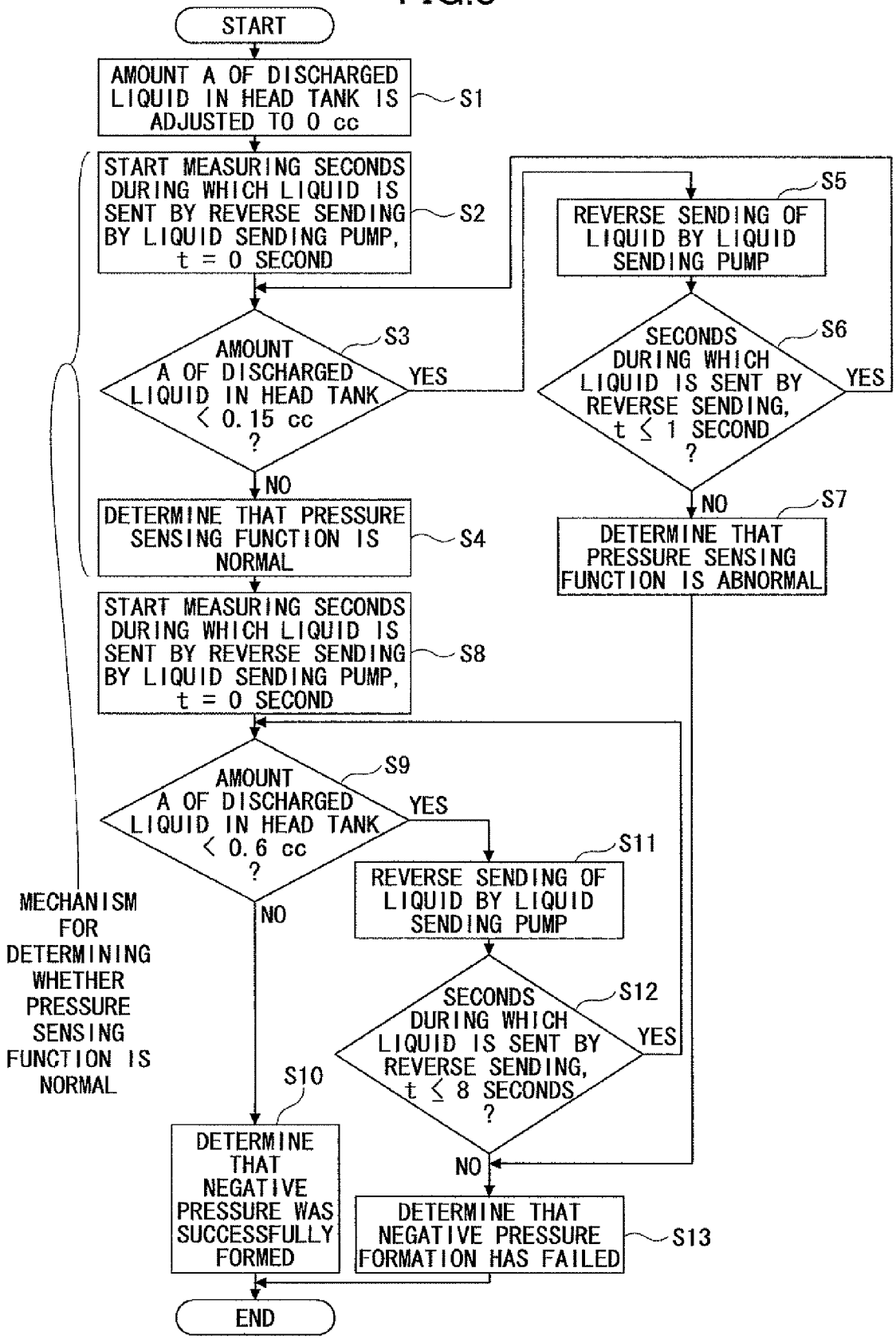
FIG. 8 is a flowchart showing negative pressure formation control by sending liquid by a reverse rotation of the liquid sending pump.

Here, a description is made of a difference between the case of using the above-described control according to an embodiment of the present invention and the case of not using the above-described control. Now, a description is made of the case where the control described in FIG. 8 is used. The amount of discharged liquid is 0.6 cc at maximum when the liquid is sent by the reverse sending for one second or less, even when the pressure sensing function is abnormal. Thus, it can be determined whether the pressure sensing function is normal within a range of negative pressure at which a meniscus can be held. In the case where the embodiment of the present invention is not used, liquid is sent by the reverse sending for eight seconds when the pressure sensing function is abnormal. In this case, the maximum amount of discharged liquid in the head tank reaches 4.8 cc (0.6 cc/s×8 s). In that case, the pressure in the head tank becomes an excessively negative pressure that exceeds the range of negative pressure values at which the meniscus can be held, and there is a risk of including (suctioning) air from inside the nozzles.

Figure 9:
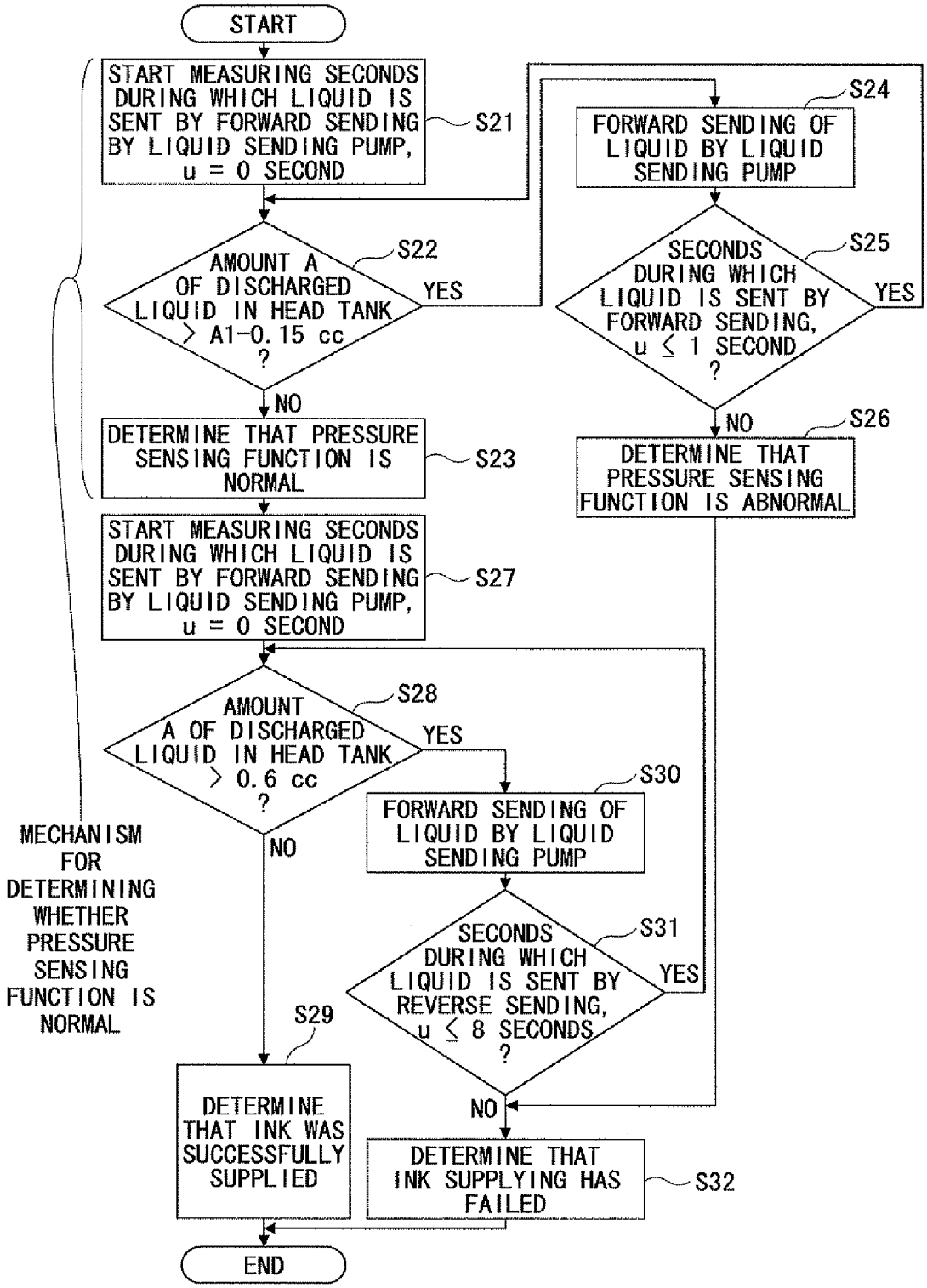
FIG. 9 is a flowchart showing ink supplying control by sending liquid by a forward rotation of the liquid sending pump.

Next, a description is made of a control to supply ink by sending liquid by the forward sending with reference to the flowchart of FIG. 9.

Here, conditions are defined as follows, and various Md design values are known in advance.

v: Liquid sending speed of the supply pump (variable)

v_min: 0.15 cc/s: Minimum value of the liquid sending speed of the supply pump v_max: 0.60 cc/s: Maximum value of the liquid sending speed of the supply pump A: Amount of discharged liquid in the head tank (variable)

A1: Amount of discharged liquid in the head tank before start 0 to 2.2 cc: Amount of discharged liquid in the head tank to keep a negative pressure value at which a meniscus can be held u: Seconds during which the forward sending of liquid is performed by the supply pump (variable)

As an example, a description is made of control to send liquid by the forward sending until a target negative pressure value (0.6 cc of the amount of discharged liquid in the head tank) is achieved, in the case where the amount A of discharged liquid in the head tank becomes A1 (≥1.1 cc). The amount A of discharged liquid in the head tank is sensed by, for example, a method for recording a result of accumulating the amount of ink consumed in a state that is not opened to the atmosphere, as a soft count.

By controlling as shown in FIG. 9, it is determined whether the pressure sensing function is normal in S21 to S26. This part corresponds to "mechanism for determining whether pressure sensing function is normal".

That is, in the case where the liquid is sent by the forward sending of the supply pump and the amount of the sent liquid reaches 0.15 cc (0.15 cc is an amount of ink that can be supplied in one second at the liquid sending speed of v_min) within specified seconds (one second), that is, when the amount of discharged liquid in the head tank reaches A1-0.15 cc within the specified seconds (one second), it is determined that the pressure sensing function is normal (S23). After it is determined that the pressure sensing function is normal, liquid is sent by the forward sending until the target negative pressure value (0.6 cc) is achieved (S27 to S32).

On the other hand, in the case where the liquid is sent by the forward sending of the supply pump and the amount of the sent liquid does not reach 0.15 cc (0.15 cc is an amount of ink that can be supplied in one second at the liquid sending speed of v_min) within specified seconds (one second), that is, when the amount of discharged liquid in the head tank does not reach A1-0.15 cc within the specified seconds (one second), it is determined that the pressure sensing function is abnormal (S26). After it is determined that the pressure sensing function is abnormal, the process proceeds to S32, and a control method, by which ink is not supplied until the target negative pressure value (0.6 cc) is achieved, is used.

By controlling as described above, it can be determined whether the pressure sensing function is normal within a range of negative pressure values in which a meniscus can be held, even when the pressure sensing function is abnormal. As a result, ink leakage from the nozzle caused by an internal pressure of the head tank being higher than the atmospheric pressure can be prevented.

Here, a description is made of a difference between the case of using the above-described control according to the embodiment of the present invention and the case of not using the above-described control. Now, a description is made of the case where the control described in FIG. 9 is used. The amount of supplied ink is 0.15 to 0.6 cc when the liquid is sent by the forward sending for one second or less when the pressure sensing function is abnormal. When the initial value A1 of the initial amount of discharged liquid is, for example, 1.1 cc, the amount of discharged liquid in the head tank becomes 0.5 to 0.95 cc. Thus, it can be determined whether the pressure sensing function is normal within a range of negative pressure in which a meniscus formation can be held, and the image forming apparatus can be stopped in a state where the meniscus formation can be held. Therefore, an ink leakage from the nozzle can be prevented. In the case where the present invention is not used, liquid is sent by the forward sending for eight seconds when the pressure sensing function is abnormal. In this case, the amount of discharged liquid in the head tank is at worst a negative value (−3.7 cc=1.1 cc−0.6 cc/s×8 s, where the negative value represents a pressure higher than the atmospheric pressure), which exceeds the range of negative pressure values at which the meniscus can be held. Thus, the pressure in the head tank becomes higher than the atmospheric pressure, whereby ink leaks from the nozzle.

Figure 10:
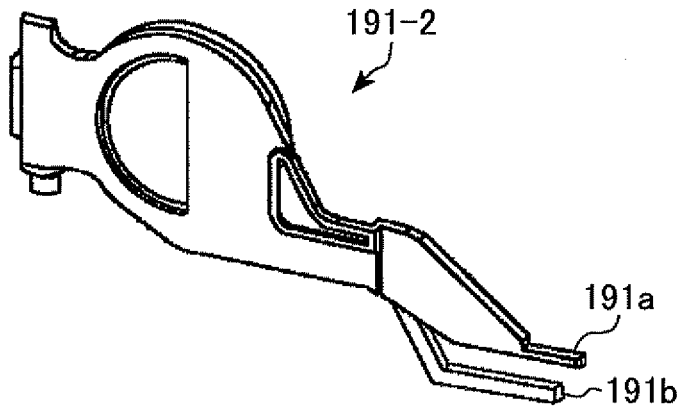
FIG. 10 is a perspective view showing another example of the negative pressure lever.

FIG. 10 is a perspective view showing another example of a negative pressure lever used for the head tank.

A negative pressure lever 191-2 shown in FIG. 10 has plural leading end parts, which are two leading end parts 191*a* and 191*b* in this example. The two leading end parts 191*a* and 191*b* are parallel to each other with a certain distance interposed therebetween. The distance (distance between the leading end parts) corresponds to a displacement amount of the lever caused when the liquid in the head tank is discharged by 0.15 cc. At least one of the plural leading ends of the lever is used for determining whether the pressure sensing function is normal. For example, the leading end part 191*a* can be used for determining whether the pressure sensing function is normal, and the other leading end part 191*b* can be used for sending liquid until a target pressure value is achieved.

The control described with reference to FIG. 8 can be used for controlling a negative pressure formation.

Effects of using the negative pressure lever shown in FIG. 10 are described.

Effect 1: Inclusion (suction) of air from inside the nozzle can be prevented.

Effect 2: The number of movements of the carriage during control can be reduced, and a maintenance time of negative pressure formation by using the mechanism for determining whether the pressure sensing function is normal can be reduced.

A description is made of a difference between the case of using the negative pressure lever 191 shown in FIG. 5 and the case of using the negative pressure lever 191-2 shown in FIG. 10.

When the negative pressure lever 191 shown in FIG. 5 is used, a control is as follows.

"1) The carriage is moved, and a position of the negative pressure lever is checked by the sensor."

"2) The carriage is moved for adjusting the amount of liquid to be sent."

"3) Liquid is sent for one second or less to determine whether the pressure sensing function is normal."

"4) The carriage is moved for adjusting the amount of liquid to be sent."

"5) Liquid is sent for eight seconds or less until the target amount 0.6 cc of discharged liquid is achieved."

When the negative pressure lever 191-2 shown in FIG. 10 is used, a control is as follows.

"1) The carriage is moved, and a position of the negative pressure lever is checked by the sensor."

"2) The carriage is moved for adjusting the amount of liquid to be sent."

"3) Liquid is sent for one second or less to determine whether the pressure sensing function is normal."

"4) Operation is unnecessary."

"5) Liquid is sent for eight seconds or less until the target amount 0.6 cc of discharged liquid is achieved"

In this manner, when the negative pressure lever 191-2 shown in FIG. 10 is used, the operation of 4) is unnecessary. Therefore, the maintenance time of the negative pressure formation by using the mechanism for determining whether the pressure sensing function is normal, can be reduced.

Figure 11:
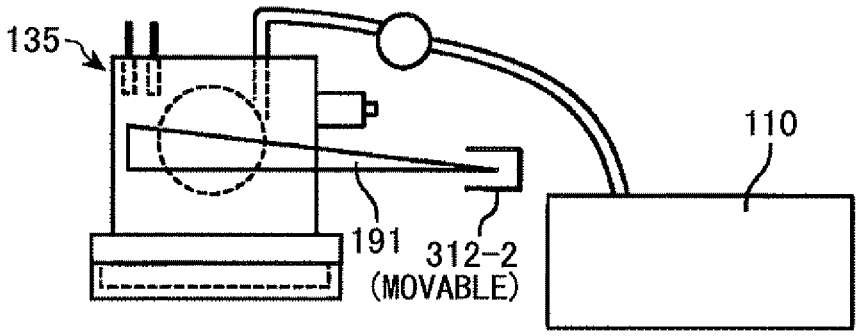
FIG. 11 is a schematic diagram showing a configuration example using a movable sensor for sensing a position of the negative pressure lever.

FIG. 11 is a schematic diagram showing a configuration example in which a movable sensor is used as the sensor for sensing a position of the negative pressure lever. The configuration of this example is the same as that of FIG. 6 except that a sensor 312-2 is configured movably in the main scanning direction (parallel to the scanning direction of the carriage). The sensor 312-2 is moved by the same configuration as a configuration for moving the carriage 133. The negative pressure lever may be the lever 191 shown in FIG. 5 or the lever 191-2 shown in FIG. 10.

The sensor 312-2 is normally moved in a state tightly contacted with the carriage 133 in parallel to the carriage 133, and can be moved when necessary, such as when adjusting the amount of liquid to be sent.

The control described with reference to FIG. 8 can be used for controlling a negative pressure formation.

Effects of using the movable sensor 312-2 are described.

Effect 1: Inclusion (suction) of air from inside the nozzle can be prevented.

Effect 2: The number of movements of the carriage during control can be reduced, and a maintenance time of a negative pressure formation by using the mechanism for determining whether the pressure sensing function is normal, can be reduced.

A description is made of a difference between the case of using the fixed sensor 312 and the case of using the movable sensor 312-2.

When the fixed sensor 312 is used, a control is as follows.

"1) The carriage is moved, and a position of the negative pressure lever is checked by the sensor."

"2) The carriage is moved for adjusting the amount of liquid to be sent."

"3) Liquid is sent for one second or less to determine whether the pressure sensing function is normal."

"4) The carriage is moved for adjusting the amount of liquid to be sent."

"5) Liquid is sent for eight seconds or less until the target amount 0.6 cc of discharged liquid is achieved."

When the movable sensor 312-2 is used, a control is as follows.

"1) The carriage is moved, and a position of the negative pressure lever is checked by the sensor."

"2) The sensor is moved for adjusting the amount of liquid to be sent."

"3) Liquid is sent for one second or less to determine whether the pressure sensing function is normal."

"4) The sensor is moved for adjusting the amount of liquid to be sent."

"5) Liquid is sent for eight seconds or less until the target amount 0.6 cc of discharged liquid is achieved."

Being smaller and lighter than the carriage 133, the sensor 312-2 can be moved at a higher speed than the carriage 133. By using the movable sensor 312-2, the maintenance time of the negative pressure formation by using the mechanism for determining whether the pressure sensing function is normal, can be reduced.

Figure 12:
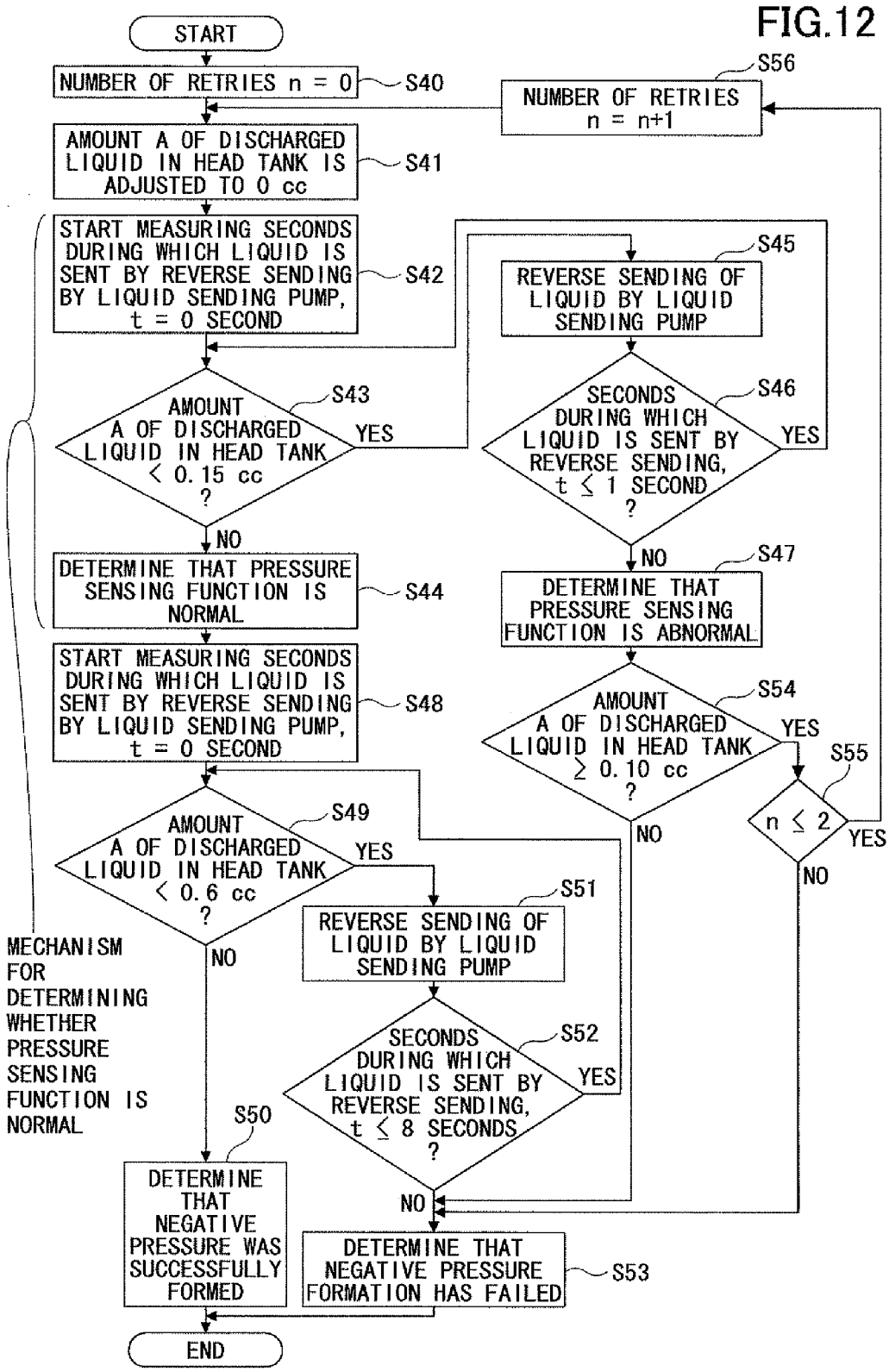
FIG. 12 is a flowchart showing a different control example of the negative pressure formation control.

Next, a description is made of a different example of the control of negative pressure formation with reference to FIG. 12. A feature of this example is a part after it is determined that the pressure sensing mechanism is abnormal.

In the flowchart shown in FIG. 12, the number of retries n is reset to 0 (S40) first, and the amount A of discharged liquid in the head tank is adjusted to 0 cc (S41). Subsequent parts S42 to S47 correspond to "mechanism for determining whether pressure sensing function is normal" and are operated similarly to "mechanism for determining" (determination mechanism) of S2 to S7 in the flowchart of FIG. 8. Therefore, descriptions are omitted to avoid overlaps. Parts S48 to S53 after the pressure sensing function is determined to be normal by the determination mechanism are similar to S8 to S13 in the flowchart of FIG. 8. Therefore, overlapped descriptions are omitted.

After it is determined that the pressure sensing function is abnormal by the above-described determination mechanism in S47, it is checked whether the amount A of discharged liquid in the head tank has reached 0.10 cc (S54). If the amount A of discharged liquid in the head tank does not reach 0.10 cc, the process proceeds to S53 and it is determined that the negative pressure formation has failed. On the other hand, when the amount A of discharged liquid in the head tank has reached 0.10 cc, the process proceeds to S55 and it is determined whether the number of retries is two or less. When the number of retries is more than two (three or more), the process proceeds to S53. When the number of retries is two or less, the process proceeds to S56, whereby the number of retries is incremented. Then, the process returns to S41 and it is checked again whether the pressure sensing function is normal.

For example, even if actual performance values of the liquid sending speed of the liquid sending pump are equivalent to 0.15 to 0.60 cc/s, there may accidentally be a case where the actual performance value is only up to 0.10 cc/s at worst, due to a collapse of the tubing pump caused when left untreated, a variation of the roller of the tubing pump, and the like. However, a speed at which the pump sends liquid will eventually be 0.15 to 0.60 cc/s while the pump is operated.

Even on the assumption as described above, by repeating the determination of whether the pressure sensing function is normal by using the control shown in FIG. 12, a likelihood that the pressure sensing function is normal is increased, and a likelihood of successfully forming a negative pressure can be increased.

Figure 13:
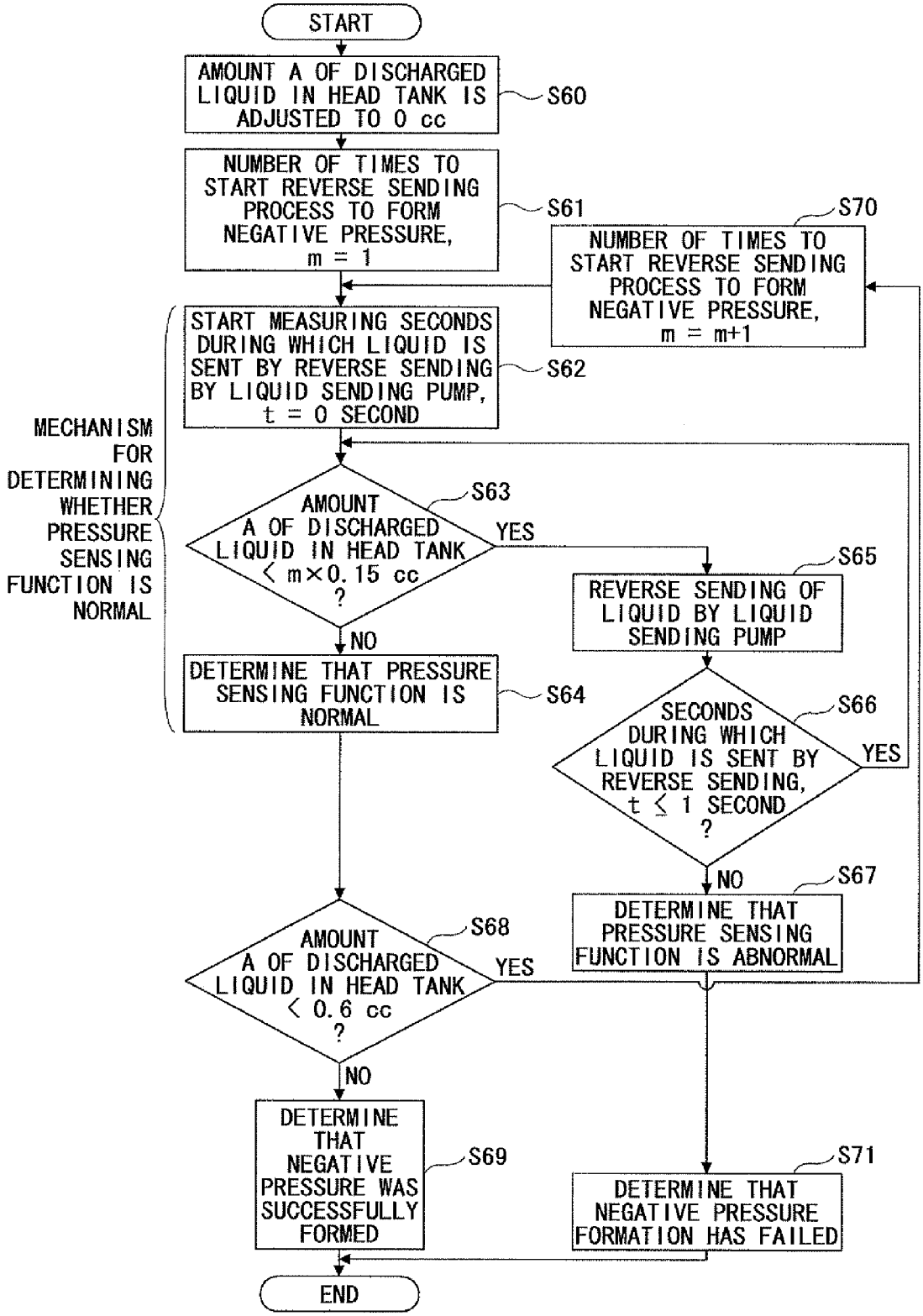
FIG. 13 is a flowchart showing a further different control example of the negative pressure formation control.

Next, a description is made of a further different example of the control of negative pressure formation with reference to FIG. 13. A feature of this example is a part after it is determined that the pressure sensing mechanism is normal.

In the flowchart of FIG. 13, first, the amount A of discharged liquid in the head tank is adjusted to 0 cc (S60) and the number of times m to start a reverse sending process for forming a negative pressure is set to 1 (S61). Subsequent parts S62 to S67 correspond to "mechanism for determining whether pressure sensing function is normal" and are operated similarly to the "mechanism for determining" of S2 to S7 in the flowchart of FIG. 8. Therefore, descriptions are omitted to avoid overlaps.

After it is determined that the pressure sensing function is normal (S64), it is checked (S68) whether the pressure in the head tank is less than a target negative pressure value (whether the amount A is less than 0.6 cc). When the pressure in the head tank is equal to or more than the target negative pressure value (when the amount A is 0.6 cc or more, corresponding to "NO" in S68 of FIG. 13), it is determined that the negative pressure was successfully formed (S69). When the pressure in the head tank is less than the target negative pressure value in S68 (when the amount A is less than 0.6 cc, corresponding to "YES" in S68 of FIG. 13), the process proceeds to S70 and the value m is incremented. Then, the process returns to S62 and it is determined again whether the pressure sensing function is normal.

On the other hand, when it is determined that the pressure sensing function is abnormal (S67), it is determined that the negative pressure formation has failed (S71).

In this control example as described above, after it is determined that the pressure sensing function is normal by the "mechanism for determining" (determination mechanism), the reverse sending of the liquid by the determination mechanism is performed again to repeat the determination. As a result, the precision of "determination mechanism" is enhanced, and the negative pressure can be more safely formed.

Although the present invention has been described above, the present invention is not limited to the configurations and control examples shown in the drawings. For example, various values of the controls of the negative pressure formation and ink supplying can be arbitrarily set in accordance with a configuration of the head tank and other configurations. Further, the entire configuration of the image forming apparatus, configuration of the inkjet engine part, configuration of the head tank, configurations for sensing an amount of discharged liquid and a pressure in the head tank, mechanism for supplying ink from the ink cartridges, or the like can be arbitrarily changed within an applicable range of the present invention.

Further, the present invention is not limited to a serial type image forming apparatus, and can be applied to a line type image forming apparatus whose recording head does not move. The number of colors of inks, the number of ink cartridges, and the like are arbitrary as well. Further, the present invention can be applied to a monochrome image forming apparatus in addition to the color image forming apparatus. As the image forming apparatus, arbitrary modes can be employed such as a printer, a copier, a facsimile, or a multifunction peripheral having plural functions.

According to at least one embodiment of the invention, it can be determined whether a pressure sensing function is normal with a negative pressure value of the head tank in a range that a meniscus can be held, even when the pressure sensing function is abnormal. When it is determined that the pressure sensing function is abnormal, the apparatus is stopped in a state where the meniscus can be held. Accordingly, the inclusion (suction) of air from inside the nozzle and ink leakage from the nozzle can be prevented.

According to at least one embodiment of the invention, it can be accurately determined whether the pressure sensing function is normal with a negative pressure value of the head tank in a range that a meniscus can be held, and the inclusion (suction) of air from inside the nozzle and ink leakage from the nozzle can be prevented.

According to at least one embodiment of the invention, the number of movements of the carriage during control can be reduced, and the maintenance time of the negative pressure formation by using the mechanism for determining whether the pressure sensing function is normal can be reduced.

According to at least one embodiment of the invention, the number of movements of the carriage during control can be reduced, and the maintenance time of the negative pressure formation by using the mechanism for determining whether the pressure sensing function is normal can be reduced.

According to at least one embodiment of the invention, even when it is determined that the pressure sensing function is abnormal, determination of whether the pressure sensing function is abnormal can be repeated. Therefore, a likelihood in that the pressure sensing function is normal is increased, and a likelihood in that a negative pressure is successfully formed can be increased.

According to at least one embodiment of the invention, after the pressure sensing function is determined to be normal, the determination of whether the pressure sensing function is normal is performed again. As a result, the precision of determining whether the pressure sensing function is normal is enhanced, and a negative pressure can be more safely formed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teachings herein set forth.

This patent application is based on Japanese Priority Patent Application No. 2010-057422 filed on Mar. 15, 2010, the entire contents of which are hereby incorporated herein by reference.

What is claimed is:

1. A method for controlling an image forming apparatus including a liquid droplet discharge head having a nozzle configured to discharge a droplet of liquid;

a sub-tank configured to temporarily store the liquid supplied to the liquid droplet discharge head;

a main tank configured to store the liquid;

a liquid sending pump capable of sending the liquid from the main tank to the sub-tank by forward sending and sending the liquid from the sub-tank to the main tank by reverse sending; and a pressure sensing unit configured to sense a pressure in the sub-tank, wherein the pressure sensing unit includes a negative pressure lever configured to perform a pressure sensing function to sense the pressure in the sub-tank on a basis of a sensing result of the position sensing unit and to be displaced in accordance with an amount of the liquid stored in the sub-tank, the negative pressure lever including plural leading end parts parallel to each other, indicating different positional information from each other and separated by a specific separation distance interposed therebetween, and a position sensing unit configured to detect a displacement of the negative pressure lever as positional information, and the method comprising:

before sending the liquid by the forward sending or the reverse sending by the liquid sending pump to achieve a target negative pressure value of a pressure in the sub-tank, performing a determination of whether the pressure sensing function of the pressure sensing unit is normal by sending the liquid by the liquid sending pump with the pressure in the sub-tank being at a negative pressure in a range in which a meniscus of the liquid formed in the nozzle is maintained; and when it is determined that the pressure sensing function is abnormal, controlling not to send the liquid by the liquid sending pump to achieve the target negative pressure value of the pressure in the sub-tank, wherein a displacement amount, detected by the position sensing unit, of at least one of the plural leading end parts is employed in the determination of whether the pressure sensing function is normal, wherein a displacement amount, detected by the position sensing unit, of at least another of the plural leading end parts is employed in the determination of whether the target negative pressure value has been achieved, and wherein the separation distance interposed between the leading end parts corresponds to a displacement amount when the liquid in the sub-tank is discharged by a predetermined volume.

2. The method for controlling the image forming apparatus as claimed in claim 1, wherein it is determined that the pressure sensing function is abnormal when the liquid is sent by the liquid sending pump for a predetermined period of time or less within a range in which the meniscus of the liquid formed in the nozzle is maintained and a displacement amount of the pressure in the sub-tank caused by the liquid sent by the liquid sending pump is less than a theoretically possible displacement amount of the pressure calculated from an actual performance value of the liquid sending pump.

3. The method for controlling the image forming apparatus as claimed in claim 1, wherein the position sensing unit is provided to be movable in a direction in which the liquid droplet discharge head moves.

4. The method for controlling the image forming apparatus as claimed in claim 1, wherein when it is determined that the pressure sensing function is abnormal, the determination of whether the pressure sensing function is normal can be performed again depending on the pressure in the sub-tank.

5. The method for controlling the image forming apparatus as claimed in claim 1, the method further comprising: when it is determined that the pressure sensing function is normal, controlling to perform the determination of whether the pressure sensing function is normal again.

6. An image forming apparatus to which the method as claimed in claim 1 is applied.

7. An image forming apparatus comprising:

a liquid droplet discharge head having a nozzle configured to discharge a droplet of liquid;

a sub-tank configured to temporarily store the liquid supplied to the liquid droplet discharge head;

a main tank configured to store the liquid;

a liquid sending pump configured to send the liquid from the main tank to the sub-tank by forward sending and send the liquid from the sub-tank to the main tank by reverse sending;

a control mechanism to control operation of the liquid sending pump; and a pressure sensing unit configured to sense a pressure in the sub-tank, the pressure sensing unit including a negative pressure lever configured to perform a pressure sensing function to sense the pressure in the sub-tank on a basis of a sensing result of the position sensing unit and to be displaced in accordance with an amount of the liquid stored in the sub-tank, the negative pressure lever including plural leading end parts parallel to each other, indicating different positional information from each other and separated by a specific separation distance interposed therebetween, and a position sensing unit configured to detect a displacement of the negative pressure lever as positional information, and wherein the control mechanism, before sending the liquid by the forward sending or the reverse sending by the liquid sending pump to achieve a target negative pressure value of a pressure in the sub-tank, performs a determination of whether pressure sensing function of the pressure sensing unit is normal by sending the liquid by the liquid sending pump with the pressure in the sub-tank being at a negative pressure in a range in which a meniscus of the liquid formed in the nozzle is maintained, and wherein the control mechanism employs a displacement amount, detected by the position sensing unit, of at least one of the plural leading end parts, in the determination of whether the pressure sensing function is normal, and employs a displacement amount, detected by the position sensing unit, of at least another of the plural leading end parts is employed in the determination of whether the target negative pressure value has been achieved, wherein when the control mechanism determines that the pressure sensing function is abnormal, controlling not to send the liquid by the liquid sending pump to achieve the target negative pressure value of the pressure in the sub-tank, and wherein the separation distance interposed between the leading end parts corresponds to a displacement amount when the liquid in the sub-tank is discharged by a predetermined volume.

* * * * *